United States Patent [19]

Schneider

[11] 4,012,805

[45] Mar. 22, 1977

[54] CARPET SHAMPOOER

[75] Inventor: Helmut Schneider, Mainz, Germany

[73] Assignee: Werner & Mertz GmbH, Mainz, Germany

[22] Filed: Apr. 28, 1976

[21] Appl. No.: 681,213

[30] Foreign Application Priority Data

Apr. 29, 1975 Germany ..... 2518941

[52] U.S. Cl. ..... 15/50 R

[51] Int. Cl.[2] ..... A47L 11/34

[58] Field of Search ..... 15/29, 50 R, 98, 320

[56] References Cited

UNITED STATES PATENTS 1,581,824 4/1926 Amsel et al. ..... 15/50 R X 3,121,896 2/1964 Allen et al. ..... 15/50 R 3,404,420 10/1968 Lachat et al. ..... 15/50 R X

*Primary Examiner*—Edward L. Roberts

*Attorney, Agent, or Firm*—Karl F. Ross; Herbert Dubno

[57] ABSTRACT

A carpet shampooer with prefoaming means for the shampooing agent. The prefoaming means comprises a fixed member on the machine housing having projections which cooperate with formations on the rotating brush or brushes to subject the foaming agent which is introduced between the interdigiting formations to agitation in order to foam it before it contacts the carpet.

14 Claims, 5 Drawing Figures

FIG. 3
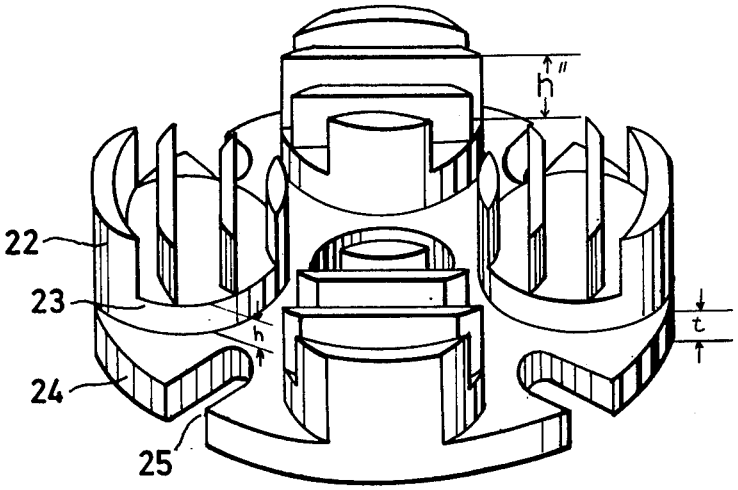
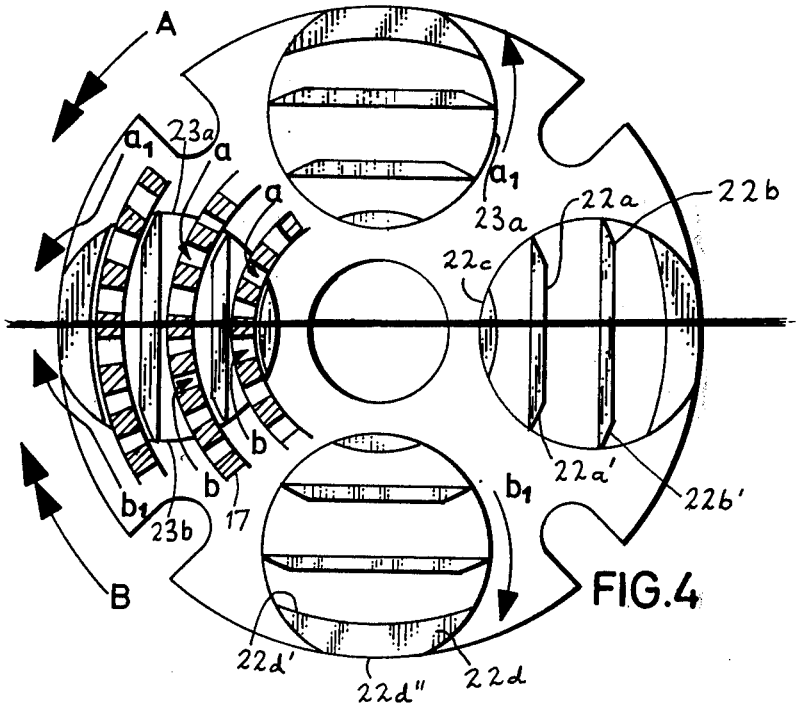
FIG.4

CARPET SHAMPOOER

FIELD OF THE INVENTION

The present invention relates to a carpet-shampooing apparatus and, more particularly, to a carpet shampooer having rotating brushes and means for prefoaming the shampooing agent so as to prevent soaking of the carpet during shampooing while permitting maximum soil removal.

BACKGROUND OF THE INVENTION

Carpet-shampooing devices having counterrotating cup-disk brushes are known in a variety of constructions. For the purposes of this description, a cup-disk is a brush constituted by a disk which is rotated and from which an annular array of bristles extend generally downwardly, the cup being an upwardly open central cavity in the brush.

The machine generally comprises, in addition to a housing on which the brushes are journaled for rotation about vertical axes perpendicular to the planes of their disks, a handle extending from the housing and enabling the operator to push the apparatus across the carpet or rug, a motor on or in the housing for driving the brushes in opposite sense so that they do not produce a resultant lateral movement, a receptacle for the shampooing agent and a valve system, generally operated by a trigger or other device on the handle, enabling the shampooing agent to be discharged onto the carpet and brush bristles.

Generally speaking conventional shampooing machines of this type resemble multiple-disk household floor-polishing or waxing machines and can have two, three or even four disk brushes. When two disk brushes are used, they are always driven in opposite senses to counteract the tendency of each brush to swing the machine to one side. In single-brush machines, however, the operator must constantly exert a force to counteract this tendency.

In polishing machines the disk brushes carry the entire weight of the apparatus, i.e., the motor, the housing and the handle, the downward force being applied to the shaft carrying the brush. However, in shampooing apparatus the motor and housing may be supported by wheels although the brush bristles nevertheless engage the carpet and penetrate at least to a limited extent into the pile thereof during the shampooing process.

The housing may comprise a motor-support plate, direction-changing gearing (when the motor shaft lies horizontally) to rotate the brushes about vertical axes, gearing to produce the counterrotation of the two brushes and/or speed-reducing gearing, such as a worm drive, to transform the motor output to the optimum brush speed for the shampooing operation.

The housing may be surrounded by an apron which extends downwardly, although this apron should not reach the floor surface and thereby prevent effective shampooing. The housing may be completed by a protective cover for the motor and transmission elements, bearings and the like.

The handle may either be of a T-construction having opposing hand grips similar to those of a bicycle, or of loop construction. The lower portion of the handle or loop is formed with a hinge which enables the housing to maintain a horizontal position regardless of the manner in which the upper end of the handle is held by the operator.

Electric current supply to the motor is effected by a cable which can run directly to the motor housing or can pass through the handle and extend out of a grip thereof.

The tank, generally carried on the handle structure, customarily has a capacity of about 2 to 4 liters and is provided with a filling opening through which shampoo can be introduced, a vent to allow air into the tank as the shampooing agent drains therefrom and the aforementioned valve mechanism which, by operation of a lever on the handle, communicates the interior of the tank with a tube running between the motor-support plate and the brushes.

Either at this plate or further above the liquid is branched into two passages which open close to the axles of the brushes to permit the shampooing agent to pass downwardly into the rotating cups of the cup-disk brushes. The liquid is cast outwardly by centrifugal force, generally without prefoaming, onto the bristles and the carpet where agitation of the brush bristles against the carpet pile in the presence of the liquid produces the foam necessary for effective cleaning.

Since the shampooing agent is a substance of high wetting capability, it is readily taken up by capillary passages of the carpet material. Consequently, any portion of the shampooing agent which is not immediately converted to foam by agitation of the bristles is no longer available for foaming. Of course, effective foaming can also occur when there is practically complete saturation of the carpet material so that the bristles agitate a wet carpet surface.

The operator opens and closes the valve as he deems necessary for effective shampooing and usually must hold the valve open to saturate the carpeting before he is able to notice the development of the foam. Since the bristles are most effective only along the carpet's upper surface and only lightly engage the latter, a fraction of the shampooing agent absorbed in the carpet is agitated sufficiently to form the foam. Since the operator may not see enough foam he will tend to hold the valve open longer, causing still more soaking of the carpet.

The result is an extremely wet and liquid-permeated carpet, slow progress of the machine thereover and less than effective shampooing. With such earlier apparatus it has not been possible to apply effectively a shampooing foam to the floor with the bristles.

In another type of carpet shampooer, namely, the drum-type, it has been known for some time to foam the shampooing agent before it contacts with the carpet, permitting effective cleaning with minimum soaking; thus the foam is a dilution of the shampooing agent with air and has a higher viscosity than the shampooing liquid and a reduced density, enabling it to be easily spread on the carpet with little tendency to penetrate deeply therein. German published application — Auslegeschrift — No. 1,557,240 describes such a drum-type device in which a dried foam is preformed and is massaged into the carpet with mechanical oscillation.

The shampooing agent, even after vacuuming of the dried residues together with the released foam, is found in these systems not to penetrate sufficiently deeply into the pile of the carpet and even where it does manage to penetrate the carpet deeply, cannot readily be removed by vacuuming and hence remains as a dirt-carrying substance. The latter disadvantage also characterizes those shampooing systems where the carpet is soaked and thereafter subjected to vacuuming in the wet state.

The German utility model (Gebrauchsmusterschrift) No. 7412248 describes an accessory which is capable of generating foam by mixing air with the shampooing agent before the latter reaches the carpet. The accessory uses the rotating brushes for the prefabrication of the foam. On the surface of the lower horizontal bottom portion of the cup wall of the brush there are pivoted radial entraining ribs at the hub of the brush which cooperate with nonrotating fixed annular brushes within the brush cup and which have bristles designed to pass into the space between the ribs. As the bristles of the accessory brushes strike the ribs a foam is formed in accordance with the washboard principle. The foam is expelled through lateral passages in the brush cup to the bristle crown of the shampooer brushes and then along these bristles onto the carpet. The shampooing agent is thus not soaked into the carpet but is worked into the latter by the bristle crowns of the shampooer brushes. The advantage of this system is that substantially less shampooing agent is required than with systems in which the carpet is permeated by the foaming agent and a soaking of the carpet is avoided.

It has been found, however, that the last-mentioned prefoaming system is not practical. Firstly, the impact between the nonrotating brush and the ribs increases the already high resistance to brush rotation, putting a significant load upon the motor. Furthermore, the nonrotating brush annulus is subject to rapid deterioration and must either be frequently replaced or operated in an inefficient manner.

Furthermore, when the machine is stopped, the foam-generating brushes may be permanently deformed by the ribs and are thus gradually rendered ineffective.

There has been proposed a variation to the system described above (see German utility model — Gebrauchsmusterschrift — No. 7443261). In this construction, instead of ribs, the rotating cup bottom of the cup-disk brush is provided with tooth crowns and in the spaces between the tooth crowns and/or between the outer tooth crowns and the cylindrical periphery of the cup wall, nonrotating fixed impingement baffles are received with clearance. The shampooing agent is introduced at the center of the cup-disk brush and passes through the gaps between the tooth crowns outwardly to spray upon the impingement walls and generate foam. Finally the foam is forced outwardly through openings in the peripheral wall and is supplied to the carpet.

Because of the clearances between the cooperating moving and nonmoving parts the additional friction factors and dangers of the earlier systems are avoided. However, even this system has some significant disadvantages, since experience has shown that it can operate only with sprays having a relative strong throughflow of the shampooing liquid. With low liquid flow rates the shampooing agent forms a film through the gap and does not spray against the impingement walls, thus passing out of the system in an unfoamed state.

A rigid impingement wall system designed to be free from contact or friction when cooperating with the tooth crowns is also expensive because it requires precise positioning and machining of the impingement walls. In spite of a desire to avoid contact between the rotating and nonrotating parts, contact occasionally occurs and when the gaps through which the liquid can pass are minimized, this danger increases. Particularly with relatively slow rotation and low liquid supply rates it is impossible to prevent migration of the liquid film without foaming to the outlet even with the most elaborate of design and fabrication efforts.

OBJECT OF THE INVENTION

It is the principal object of the present invention to provide an improved shampooing apparatus which avoids the disadvantages of the prior-art devices but nevertheless retains the advantages thereof and prefoams the shampooing agent before it contacts the carpet.

SUMMARY OF THE INVENTION

This object can be attained, in accordance with the invention, in a shampooing apparatus of the cup-disk brush type in which the rotation of the brush disks produces a dry foam with a minimum of energy consumption and hence brings about an intimate contact between the shampooing liquid and the air with a minimum of friction loss.

The system of the present invention comprises at least one rotating cup-disk brush having an annular array or crown of bristles which extend downwardly toward the carpet and project below the cup bottom for engagement with the carpet. The supply tank is connected by a valve with duct means opening into the cup of the brush and the latter is provided with a cylindrical wall rising upwardly from the cup bottom and formed with an outlet opening for the foam. The invention resides in providing an impingement wall system drawing air into the cup of the brush and working the air into the shampooing liquid to form the foam which consists of at least two impingement wall elements:

a. a first loosely held but nonrotatable wall element which is urged at least by its own weight against the cup bottom and is mounted on the underside of the motor housing; and b. a second impingement wall element formed by the cup bottom of the brush and having an array of impingement baffles interdigitating with impingent baffles carried on the first element.

The projecting impingement baffles of the first wall element rest loosely against the floor of the cup bottom between the impingement baffles thereof and the upper ends of the latter impingement baffles may bear lightly against the roots of the spaces between the impingement baffles of the first wall element. As a result the liquid cannot meander from the interior of the cup outwardly in a film and a strong mixing of the air with liquid is ensured. Preferably the baffles of the first, nonrotatable but axially floating member lie along chords which are parallel to one another and receive between them tooth crowns forming the baffles of the brush, the crowns rising from the cup bottom. The outermost baffle of the floating member may be curved to conform to the diameter of the outermost crown and the innermost baffle may likewise have a curvature corresponding to the concave curvature of the innermost crown.

It has been found to be advantageous, furthermore, to provide the first member as a disk which is formed with angularly equispaced notches along its periphery, these notches being received in projections on the bottom plate of the housing so as to enable the disks to move axially. The disks can be formed, intermediate these notches, with pedestals or lands from which the impingement baffles can project axially downwardly. It has been found to be practical to make these lands circular and integral with the disk and baffles. The teeth of the tooth crowns may be generally trapezoidal and may be designed with gaps between them so that as the teeth approach the cordal baffles, a progressively reducing flow cross section is formed for the fluids so that the latter are forced inwardly through the interstices or passages between the teeth and between the baffles, the flow cross section increases and centrifugal force assists in casting the fluid out from between the teeth through the intertooth interstices. As a result, any given portion of the liquid may be repeatedly forced inwardly and outwardly through one or more of the tooth crowns so as to insure an intimate and effective mixing with the air.

More generally, the invention resides in providing a nonrotating loosely held foam-whirling element resting with the pressure of at least its own weight upon the cup floor with transversely extending baffle walls which do not lie in the radial direction, and preferably are perpendicular to the radial direction, for throwing the fluid back toward the center of the cup but clearing the tooth crowns with enough tolerance to prevent them from being blocked by dirt particles or variations in position of the shaft support during operation.

The first baffle-carrying element is also provided with means, e.g., suitably shaped walls, for casting the foam outwardly and lies inclined to the radius but also inclined to the baffle walls which cast the foam inwardly.

According to the invention the tooth crowns or rings are provided in at least concentric circles and can have teeth of generally the same cross section so that the number of teeth reduces inwardly. The interstices between the teeth may have the same flow cross section for all tooth rings. The axial height of the teeth may be equal to the axial height of the two types of baffle walls carried by the first or floating element.

Because of the floating character of the first member, oscillation or vibrations are set up when the brush is rotated so that contact between the teeth and the roots between the baffles or contact between the baffles and the cup floor can occur to prevent liquid films from meandering from the interior outwardly.

The invention is based upon my discovery that the problem with earlier systems can be solved by providing a brush-like and slight contact between rigid baffle walls and teeth of a pair of relatively rotatable elements, especially when they are made of synthetic-resin material, under the lubricating effect of the foam-producing liquid without any material resistance, provided these parts are guided loosely enough and press only loosely against one another. The result is obtained by permitting the first member to float so as to compensate for any unevenness of the rotation of the brush and vibration of the apparatus parts including the shaft of the brush or its supporting portion.

Only one of the two cooperating members need be floating in the sense of the present invention while the other can be fixed to whichever part of the machine to which it is to be attached. Thus when the nonrotating member is to be floating, it can be guided with the projections and notches mentioned above and can be formed with a hole through which the shaft of the brush passes with clearance. In this case the tooth crowns can be rigid with the brush. Of course it is also conceivable to provide a kinetic reversal wherein the tooth crowns are carried by a member loosely received in the cup of the brush and cooperating as the floating member, with baffle walls fixed on a plate which is incapable of moving axially relative to the housing. Furthermore, either the floating member or the nonfloating member may be provided with the tooth crowns while the other member is formed with the baffle walls.

More particularly, the present invention resides in an improvement in the type of shampooing device in which at least one rotating brush, but preferably two rotating brushes, may be formed with an upwardly open cup receiving a foam-generating device which comprises an array of upwardly projecting liquid and/or foam displacing arrangements provided in the bottom of the cup, and a floating baffle body received with play in the cup but resistant from rotation therein. The device is provided with means, e.g., downwardly extending baffle walls intended to produce the foam by interdigitating with the upwardly projecting elements, and with upper baffle elements, above the first-mentioned baffle elements which are effective to displace the foam which rises to the top of the cup outwardly, preferably through an opening in the radial wall of the latter.

The principle of the present invention is that more dense foam tends to be displaced by the first-mentioned baffle element and the cooperating upward projections, along the bottom of the cup inwardly and outwardly between the various interstices to form the foam, while the upper baffle elements or surfaces are effective to displace outwardly the low-density dry foam which rises to the top in the cup.

The floating body which is received with play in the cup thus comprises two baffle wall elements. The first or lower of these baffle wall elements which can ride freely on the floor of the cup and interdigitate with the upper projections thereof and is caused to move to follow fluctuations in the position of the brush because of its play and thereby interrupt any liquid films without being clogged by dirt or the like, is a nonrotatable baffle wall element which rests upon the bottom of the cup at least with its own weight and tends, at least in the lower portions of the cup to drive the liquid and/or incipient foam inwardly. These elements are preferably walls which are inclined to the arrays of upward projections and therefore to the radius of the brush.

The second set of baffle wall elements are disposed above the lower elements and are formed with surfaces which direct the dry foam outwardly. These surfaces are also inclined to the orbit of the teeth or upward projections but are directed outwardly in the sense of rotation of the teeth.

It has been found to be particularly desirable for the generation of the foam when, in addition to the aforementioned two types of baffle wall elements, at least one cooperates with a tooth crown formed on the floor of the cup of the cup disk brush, the teeth of these crowns being coextensive with the lower wall elements of the floating disk and reaching substantially to the upper baffle elements thereof. The teeth and lower baffle elements together forming an agitator for the foam which continuously forces the foam through the interstices between the teeth and thereby generates the foaming action necessary to incorporate large amounts of air in the liquid. However, as the density of the foam decreases it tends to rise in the cup to the point where it is no longer directly forced between the lower baffle elements and the teeth but is directed by the upper baffle elements outwardly.

The upper baffle elements are formed as pedestals which can be wiped by the upper ends of the teeth as the floating disk rests upon these teeth under its own weight. Since the floating disk can be formed with a hole through which the brush shaft passes with play in all directions, the disk has a tendency to vibrate or oscillate (wobble) to insure that the lower baffle elements will wipe the floor of the cup between the two crowns while the teeth wipe the surfaces of the pedestals so that all possibility of a meandering liquid film are eliminated.

It is especially advantageous to form the interengaging parts, namely, the tooth crowns and the baffle elements of a synthetic-resin material. It has been found that such material, in cooperation with the foam-forming film produces a self-lubrication which renders the system practically frictionless in spite of the fact that there may be direct contact between the lower baffle elements and the floor of the cup, direct contact between the edges of the lower baffle elements and the teeth of the cup, and direct contact between the upper ends of the teeth and the undersides of the pedestals because of the wobbling movement of the insert disk.

According to another feature of the invention, the insert disk is held against relation with freedom of axial and slight angular or wobbling movement by a retainer mounted on the underside of the motor housing and formed along its periphery with a plurality of angularly equispaced projections reaching loosely into recesses formed on the periphery of the insert disk. Of course, the insert disk can also be spring biased downwardly to a greater or lesser extent although it is preferred to have it bear solely with its own weight on the cup.

It has been found that best results are obtained when the tolerances, i.e., clearances between the insert disk and tooth crowns are 2 to 3 mm. Some tolerances of up to say 0.5 mm can be used although they have no advantages. Tolerances of more than 3 mm can also be used although the operation of the system is not smooth in such cases and again there are no advantages.

Since the lower baffle elements are planar, i.e., are flat and disposed generally along chords of the tooth crowns, they form between each inner tooth crown and the baffle wall lying tangent to its external periphery of flow cross section which narrows progressively in the direction of rotation of the tooth crown. This reduction in flow cross section for the entrained fluid, i.e., liquid and incipient foam, causes a pressure increase therein which drives the fluid through interstices between the teeth.

On the other side, the flow cross section increases, causing a pressure drop and inducing the fluid flow out from between these interstices toward the outer periphery of the tooth crown.

In a particularly simple embodiment of the invention the foam generator can comprise three essential parts received in the cup of the brush;

a. the lower baffle wall elements which rest loosely upon the floor of the cup and constituting an annular area of spirally inwardly directed vertical baffle walls;

b. a plurality of foam effecting baffles disposed over these vertical baffle walls and forming spirally outwardly directed surfaces for driving the foam outwardly; and c. above both sets of baffle elements and fixed to the motor carrying housing, a retainer whose bosses, projections and pins engage a loosely supporting insert body which is formed with these baffle elements.

Another advantage of the system of this invention is that it is symmetrical in operation, i.e., the tooth crowns of the brush can rotate in either sense relative to the insert body and form the lower baffle elements and drive the foam out with the upper baffle elements.

BRIEF DESCRIPTION OF THE DRAWING

The above and other objects, features and advantages of the present invention will become more readily apparent from the following description, reference being made to the accompanying drawing in which:

FIG. 3 is an enlarged perspective view of the baffle disk;

FIG. 4 is a plan view of the baffle insert showing the teeth cooperating therewith and diagrammatically illustrating the liquid flow.

SPECIFIC DESCRIPTION

Figure 1:
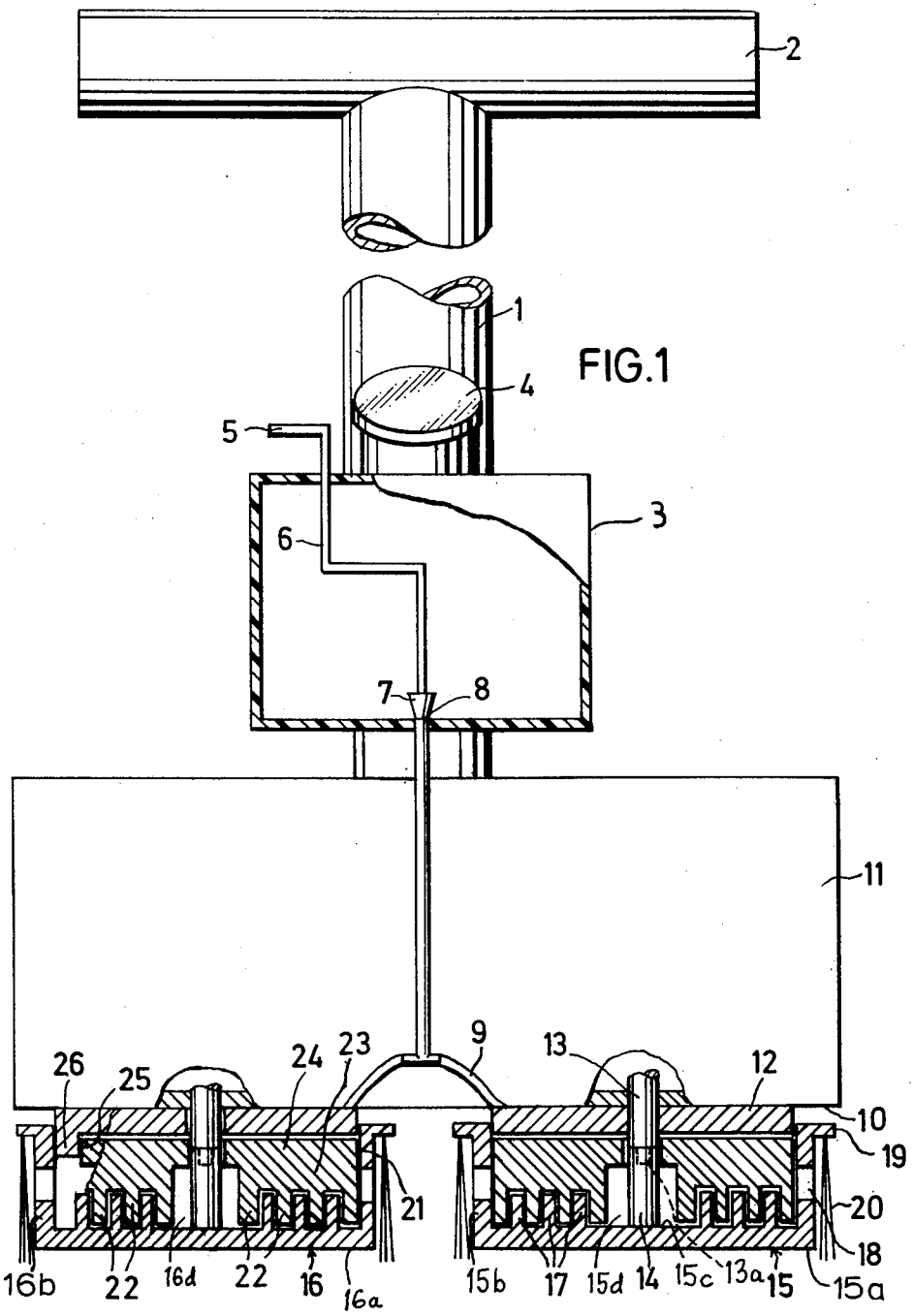
FIG. 1 is a schematic illustration of a carpet shampooer according to the invention, parts being broken away and other parts being shown in section.

In FIG. 1 I have shown the essential elements of a rug or carpet shampooer according to the present invention. The shampooer comprises a handle 2 mounted upon a shank 1 which carries a tank 3 for the shampooing liquid. A valve rod 6 in this tank is provided with a valve member 7 seated in an outlet 8 and is displaceable when the handle 5 of the valve stem is drawn upwardly to discharge the liquid. A venting and filling opening 4 may be provided for the tank 3.

The shampooing liquid passes from the outlet 8 by gravity downwardly through passages or tubes represented generally at 9 and splitting the shampooing liquid flow between a pair of orifices formed in the bottom plate of a motor housing 11 to the respective upwardly open cup-disk brushes 15 and 16. The cup-disk brushes 15 and 16 each comprise a floor **15*a*, 16*a* in the shape of a circular disk, a cylindrical wall for flange 15*b*, 16*b* rising from and fixed to this flange and an outwardly extending rim 19 at the upper end of the cylindrical wall. The bristles 20 extend downwardly from this rim 19 in a circular array around the wall 15*b* or 16*b*. Consequently, the wall and the floor form a cup or pot 15*d*, 16*d* which is upwardly open and can receive the shampooing liquid which passes through the respective orifices in the bottom plate 10.**

Although the detailed structure has not been illustrated, it will be apparent that the housing 11 contains an electric motor which may be energized through leads passing through the tubular shank 1 of the handle assembly and formed with a plug for insertion into a wall outlet or socket. The motor has its output shaft connected to the input of a speed-reducing transmission whose output shafts, rotating in opposite senses, drive the brushes 15 and 16 at a reduced speed.

The drive shafts for these brushes are represented at 13 and pass through openings in the bottom 10 of the motor housing and through central openings of retainer disks 12 which are affixed by screws **12*a*** (FIG. 2) to the underside of the motor housing.

Rising up from the floor 15*a* or 16*a* of each of the brush cups 15*d*, 16*d*, is a central socket 14 matingly receiving a non-circular formation 13*a* of the respective shaft 13 and held thereon by friction or a detent arrangement. The rotation of each shaft 13 is transmitted by the respective handle 14 to the brush 15 or 16.

The inner surface 15*c* or 16*c* of the floors 15*a*, 16*a*, of the brushes 15 and 16 are provided with teeth with axially extending angularly spaced teeth in their circular areas or tooth crowns. As illustrated, the teeth 17 project upwardly by a distance greater than a quarter but less than half of the depth of the cups of the brushes 15 and 16. The walls 15*b* and 16*b* are provided with openings from which the foam is dispensed on to the carpet.

Within the cup of each brush 15, 16 there is provided a baffle insert which has been generally represented at 21 and is so dimensioned as to float, i.e., be loosely received. The insert 21 is provided with the lower baffle elements 22 (foam turbulencers) and with upper baffle elements 23 (foam ejectors) and a common support plate 24.

Figure 2:
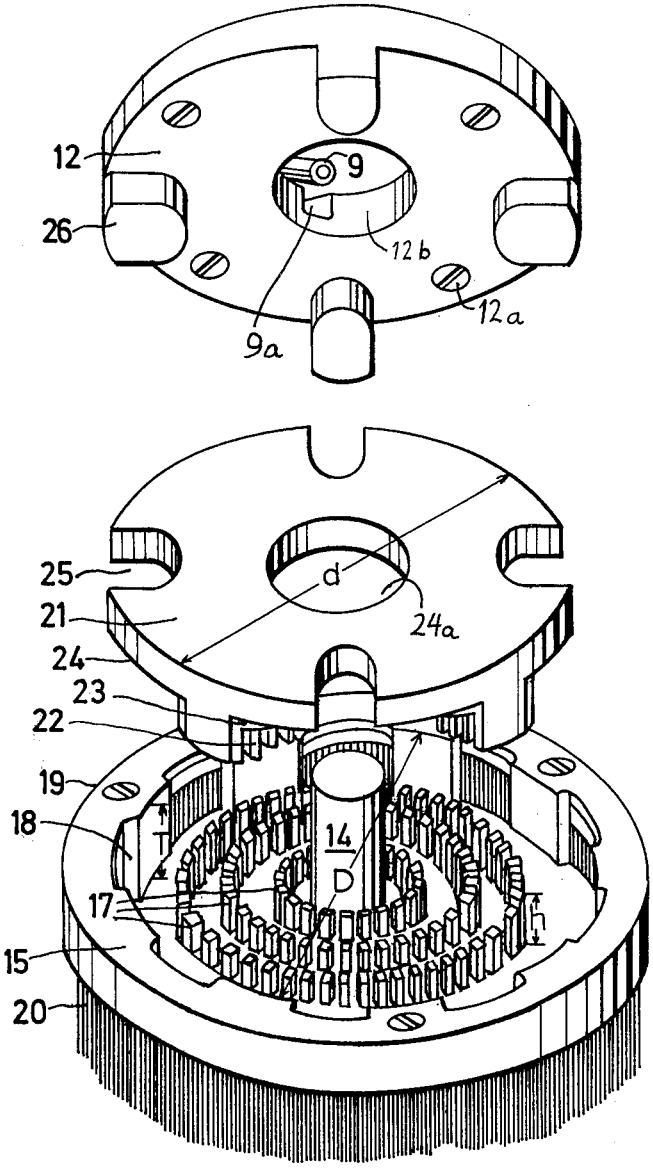
FIG. 2 is an exploded view of a brush assembly including a cup brush, a baffle insert disk and a retainer for preventing rotation of this insert disk all according to the present invention.

The upper surface of the insert 21 is best seen in FIG. 2. The support plate 24 is circular with an outer diameter *d* which can be slightly less than the outer diameter D of the inner surface of the wall 15*b* or 16*b* to allow the requisite play. The disk 24 is, moreover, formed with a central opening 24*a* which can surround the axle 14 of the brush with clearance.

Means enabling axial movement of the insert 1 but preventing it from rotating with the brush, is also provided. Such means can include notches 25 annularly equispaced around the periphery of the insert 21 and receiving retaining bosses 26 formed on the underside of the retainer 12. The bosses 26 are so shaped as to be received with play in the notches 25.

The underside of the insert 21 is best seen in FIG. 3.

Each of the foam-ejecting baffle elements 23 comprises a circular pedestal having a height *h* which, when added to the height *h'* of the teeth 17 and the thickness *t* of the disk 24 can approximately equal the depth T of the cup in which the insert is received. Each pedestal carries a pair of baffle members 22*a* and 22*b* which lie along chords of the disk 24 and hence have planar broad surfaces. The edges 22*a'* and 22*b'* are beveled or curved to enable them to closely approach the respective toothed crowns (see FIG. 4) for the purposes to be described in connection with FIG. 5.

The lower baffle elements also include an inner element 22*c* of double convex configuration with a surface 22*c'* whose radius of curvature is slightly less than the radius of the innermost toothed crown 17*a*.

The outer baffle element 22*d* has an inner surface 22*d'* which is substantially tangent to the outer toothed crown 17*c* while the surfaces 22*b'* and 22*c'* of the baffles 22*b* and 22*a*, respectively, are substantially tangent to the exteriors of the toothed crowns 17*b* and 17*a*. As can be seen in FIGS. 3 and 4, the outer periphery of baffle element 22*d*, represented at 22*d''* can have a radius of curvature corresponding to the radius of the disk 24.

Each of the teeth 17 of the toothed crowns is of trapezoidal cross section (see FIG. 4) with an inwardly turned small base, an outwardly turned side base and a pair of sides converging toward the small base.

The heights *h''* of the baffle elements 22*a* through 22*d* are approximately equal to the heights *h'* of the teeth 17.

Thus within the cups of the cup-shaped brushes 15, etc., the three toothed crowns of teeth 17 interfit with the four baffles of the lower baffle elements 22 of insert 21 when its two parts are interfitted in the position shown in FIG. 1. The insert 21 rests, via the lower end of its baffles 22*a* through 22*d* against the floor of the cup and are held against turning by the bosses 26 so that a lateral play of about 2 mm is permitted, preferably in conjunction with an axial or vertical play of also about 2 mm. In order to facilitate the axial play and permit air to penetrate into admixture with the shampooing liquid the play around the central opening is 2 to 3 mm whereby air can pass into the cup between the retaining plate 12 and the disk 24. The central opening 12*b* of the retainer disk 12 also permits the liquid to be introduced into the cup via the passage 9 which is shown to be seated in a groove 9*a*.

FIG. 4 shows the foam-ejection operation which results when the density of the foam is reduced to the point that it rises to the top of the cup and thus to the underside of the disk 24. Rotation of the brush in the counterclockwise sense is represented by the double headed arrow A in FIG. 4 while rotation of the brush in the clockwise sense is represented on the lower half of this figure by the double-head arrow B.

It will be apparent from FIG. 4 that a rotation in the counterclockwise sense, with centrifugal displacement of the foam by entrainment with the teeth 17 causes the lighter foam to engage the surface 23*a* of the pedestal 23 and ride outwardly in the direction of the single-headed arrows $a_1$ to pass through the openings 18 on to the bristles of the brush. Within the outer toothed crown 17*c*, the foam is forced by the surfaces 22*b'* and 22*a'* through the interstices between the teeth 17 as represented by the arrow *a*. Since the flow cross section between each inner tooth crown and the chord surfaces 22*a'* and 22*b'* progressively reduces, the velocity of the foam increases, the acceleration being further increased as the foam passes through the constrictions formed by the interstices of the toothed crowns. With each increase in velocity and subsequent expansion beyond each intertooth interstice, air is turbulently mixed with the liquid part of the foam to augment the foaming operation.

When the brush rotates in the opposite sense B as shown in the lower half of FIG. 4, the surfaces 23*b* are effective to cast the foam outwardly as represented by the arrows *b*, while the foam is forced inwardly below the pedestal 24 as represented by the arrows *b*. In general, therefore, the arrows $a_1$ and $b_1$ represent the direction of movement of the dry, lighter foam while the arrows *a* and *b* represent the movement of the wet more dense foam.

Figure 5:
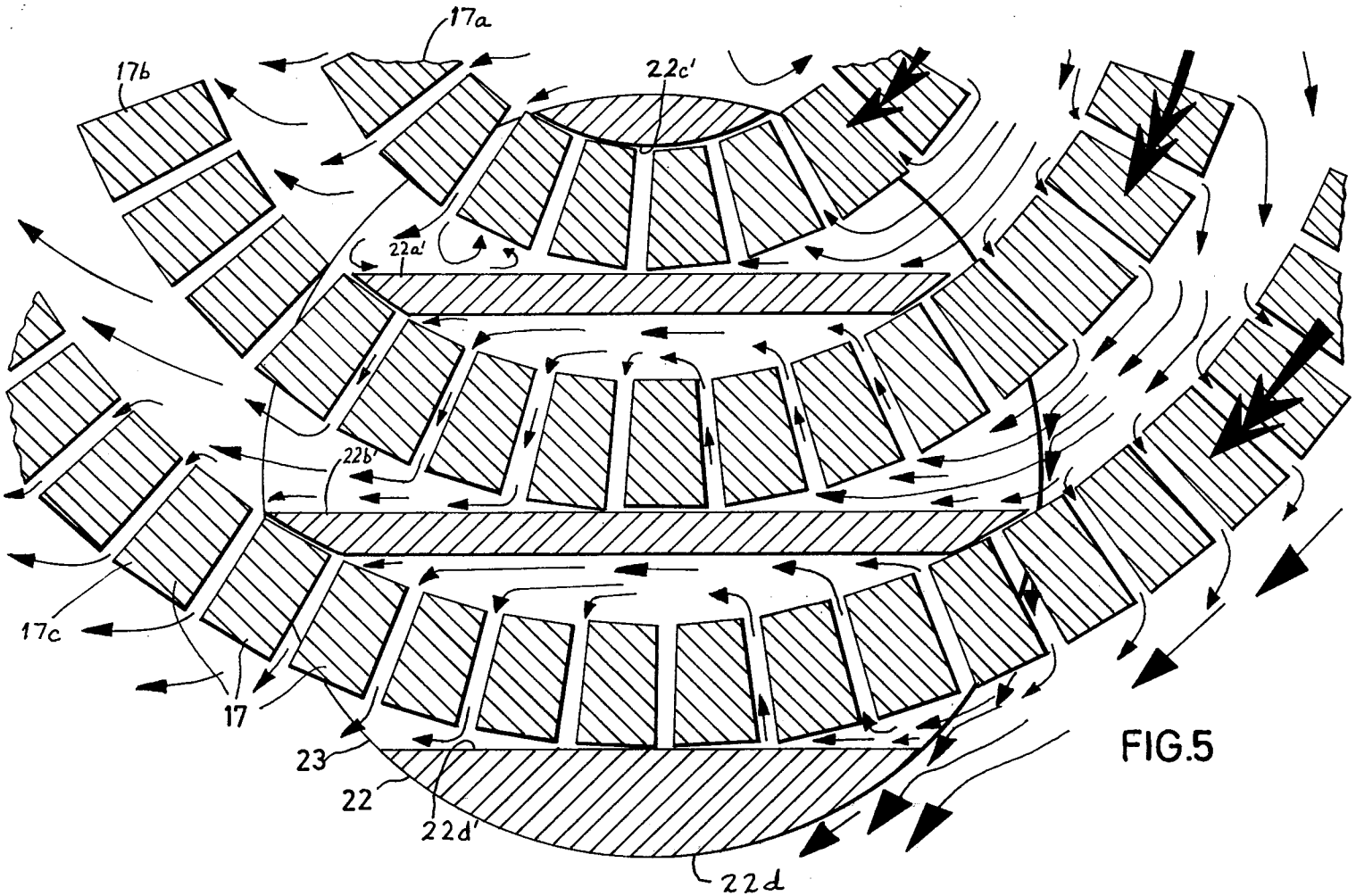
FIG. 5 is an enlarged sectional view showing the cooperation between the baffles and the teeth and detailing the flow of liquid.

FIG. 5 illustrates the paths of the liquid and foam phases in greater detail. In the figure the double-headed arrows represent the rotation of the toothed crowns while the large single-headed arrows represent the movement of the dryer foam along the surfaces 23*a* and 23*b* as noted earlier. The smaller arrows show the flow of the wet foam above the pedestal 24 between the baffles 22*a* and 22*b* and the inner toothed crowns, including the forcing of the liquid through the interstices between the teeth and the induction of the liquid and/or wet foam outwardly as the passage between each baffle 22*a* or 22*b* and the respective crowns increase in flow cross section.

As a result of the repeated forcing of the liquid through the constrictions and energence of the liquid from constrictions, the liquid is subjected to extensive turbulence and mixing with air to produce a high degree of foam. In fact, the foaming characteristics of the device of the present invention are close to those which result when a foamable liquid is forced through a macropore body and yields an open-pore foam which, with repeated turbulence becomes an extremely fine pore product which is relatively dry and contains a high proportion of air. Because the amount of air which can be mixed with the liquid phase is increased markedly with the device of the present invention the finished foam is ejected as a dry foam of high volume.

The device has other advantages as well. Because of the symmetry of the brush, retainer and insert elements, the parts may be used interchangeably with one another regardless of the sense of rotation of the brush and hence can be formed from synthetic-resin at clearly low cost. Because synthetic-resin is used for those portions of the foam which generate a device which can contact one another, the rotational resistance to the brushes is minimal, especially since the foaming liquid acts as a lubricant.

The insert 21, because it floats within the brush, interrupts any liquid-film continuity which might otherwise cause meandering of the liquid to the outlets with the foaming.

Insert 21 is provided with four pedestals with respective baffle elements because it has been found to be optimal for most purposes. However a lesser or greater number of such pedestals may be provided if desired. With fewer pedestals, however, the rate of foam generation is reduced while with a larger number it is found that the ability to draw air into the device is limited. With smaller pedestals the foam ejection is rendered more difficult. The lower baffle elements, which pass between the other crowns are preferably vertical smooth walls which are tangent to the toothed crowns to provide the reduction in flow cross section in the sense of rotation which forces the liquid or foam inwardly through the interstices between the teeth.

The devices using a minimum quantity of liquid to produce a high satisfactory foam the amount of foam generated depends only upon the rate of flow of the liquid to the cups and only with extremely large flow rates of the shampoo is the foam bound to be relatively loose and wet. A constriction can however, be provided in the liquid flow passage to regulate the flow rate of the shampoo so that the ability of the device to provide a dry foam is not exceeded.

When the carpet material requires more foam, the operator need only move more slowly over the area and hold the valve in an open condition for a longer period. This is the case when deep pile carpet is to be cleaned. With short pile carpet, of course, less time is required.

In practice it has been found that with a diameter *d* of the insert body 21 of 10 to 13 cm, a speed of 700 to 1000 rpm and a device as illustrated in the drawing, the foam has a fine porosity, stability and dryness which resembles the foams produced by aerosol cans. The result of liquid to air in the foam is found to be 1:40 as contrasted with a ratio of 1:6 for conventional cup brush foaming systems of the type hiterto used on shampoos.

I claim:

1. A carpet shampooer of the type in which at least one rotating brush engages the carpet and is formed with upwardly open cup enclosing a foam-generating device, the improvement wherein said foam-generating device comprises:

an array of upwardly projecting elements formed on the bottom of said cup for entraining a shampooing liquid and foam generated therefrom upon rotation of said brush;

a nonrotating body received in said cup and formed with downwardly extending baffle elements, said baffle elements including:

lower baffle surfaces cooperating with said upwardly projecting elements to agitate said liquid and produce a foam therefrom, and upper baffle surfaces for directing a dry foam generated in said cup and rising therein outwardly, said cup being formed with an opening for discharging said dry foam; and retaining means engaging said body for preventing rotation thereof while guiding said body floating in said cup so that said body rests upon said cup at least under its weight, said body being received with play in said cup.

2. The improvement defined in claim 1 where each of said baffle surfaces is formed symmetrically with oppositely shaped portions effective alternatively in dependence upon the sense of rotation of said brush.

3. The improvement defined in claim 2 wherein said array of upwardly projecting elements is constituted as a plurality of concentric tooth crowns, said lower surface being formed by a generally planar baffle received between two of said crowns.

4. The improvement defined in claim 3 wherein said baffle is generally tangential to the innermost of said two crowns.

5. The improvement defined in claim 4 wherein said upper surface is formed as a pedestal carrying said baffle.

6. The improvement defined in claim 5 wherein said pedestal is formed with a plurality of such baffles each received between two such crowns.

7. The improvement defined in claim 6 wherein said pedestals are circular.

8. The improvement defined in claim 7 wherein four such pedestals are provided at said body is a circular disk.

9. The improvement defined in claim 8 wherein said disk is formed with a plurality of peripheral notches, said retaining means being provided with axially extended bosses received in said notches.

10. The improvement defined in claim 9 wherein said shampooer is formed with a motor housing and said retaining means is a disk secured to the underside of said housing.

11. The improvement defined in claim 10 wherein said housing is provided with a passage opening into said cup and formed with a constriction for limiting the flow of the shampooing liquid into said cup.

12. The improvement defined in claim 10 wherein said crowns are composed of teeth of generally trapezoidal cross-section.

13. The improvement defined in claim 12 wherein said body is guided on said plate with an axial and lateral play of about 2 to 3 mm.

14. The improvement defined in claim 13 wherein said cup has a cylindrical wall surrounded by an array of bristles and provided with said opening.

* * * * *